United States Patent [19]

Hällström

[11] 4,299,107

[45] Nov. 10, 1981

[54] DEVICE FOR FORMING A COLLAR AROUND A HOLE IN THE WALL OF A PIPE

[75] Inventor: Hardy R. Hällström, Turku, Finland

[73] Assignee: G. A. Serlachius Oy, Finland

[21] Appl. No.: 81,394

[22] Filed: Oct. 3, 1979

[30] Foreign Application Priority Data

Oct. 11, 1978 [FI] Finland ..... 783102

[51] Int. Cl.[3] ..... B21D 51/40

[52] U.S. Cl. ..... 72/120; 72/117; 72/125

[58] Field of Search ..... 27/157 T; 72/112, 117, 72/120, 125; 113/116 UT

[56] References Cited

U.S. PATENT DOCUMENTS

| | | | |
|---|---|---|---|
| 3,081,812 | 3/1963 | Brown | 72/125 |
| 3,683,657 | 8/1972 | Davies | 72/112 |

FOREIGN PATENT DOCUMENTS

| | | | |
|---|---|---|---|
| 1527828 | 6/1970 | Fed. Rep. of Germany | 72/117 |
| 1752749 | 9/1976 | Fed. Rep. of Germany . | |
| 1931897 | 5/1978 | Fed. Rep. of Germany . | |
| 2153/74 | 9/1975 | Finland . | |
| 1151297 | 5/1969 | United Kingdom . | |

*Primary Examiner*—Lowell A. Larson

*Attorney, Agent, or Firm*—Scully, Scott, Murphy & Presser

[57] ABSTRACT

The invention relates to a device for forming a collar around a hole in the wall of a pipe. The device comprises a rotary body (8) which in a plane perpendicular to the rotary shaft is elliptical in cross-section and in the plane of the rotary shaft substantially circular in cross-section. The body is provided with curved support surfaces (12) located in the plane of the rotary shaft, collaring means (14) being movable along said surfaces from an inserting position adjacent to the rotary shaft to a collaring position in a point on the body with the biggest elliptical cross-section.

13 Claims, 9 Drawing Figures

Figure 1:
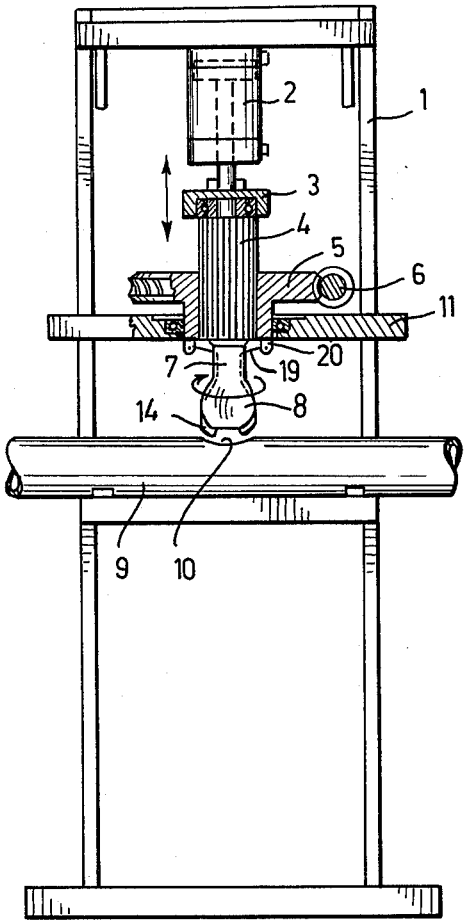

FIG. 3
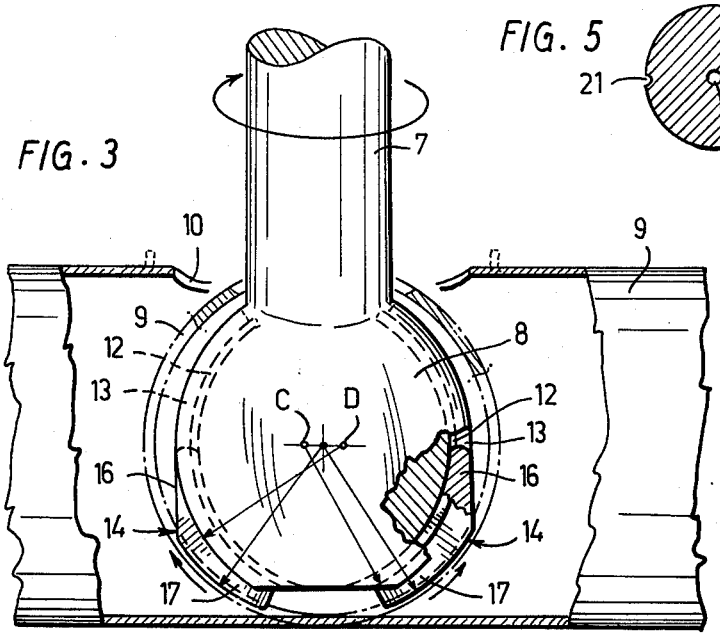
FIG. 5
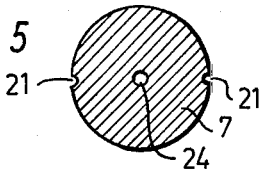
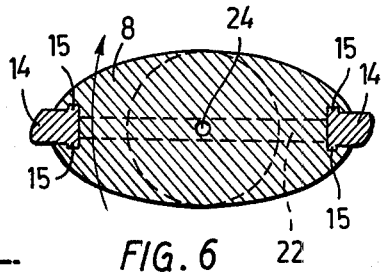
FIG. 6
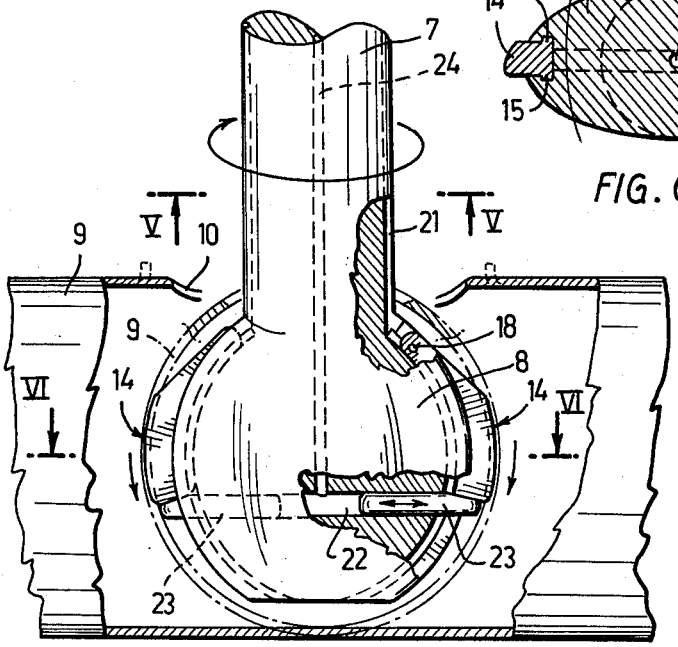
FIG. 4

FIG. 8
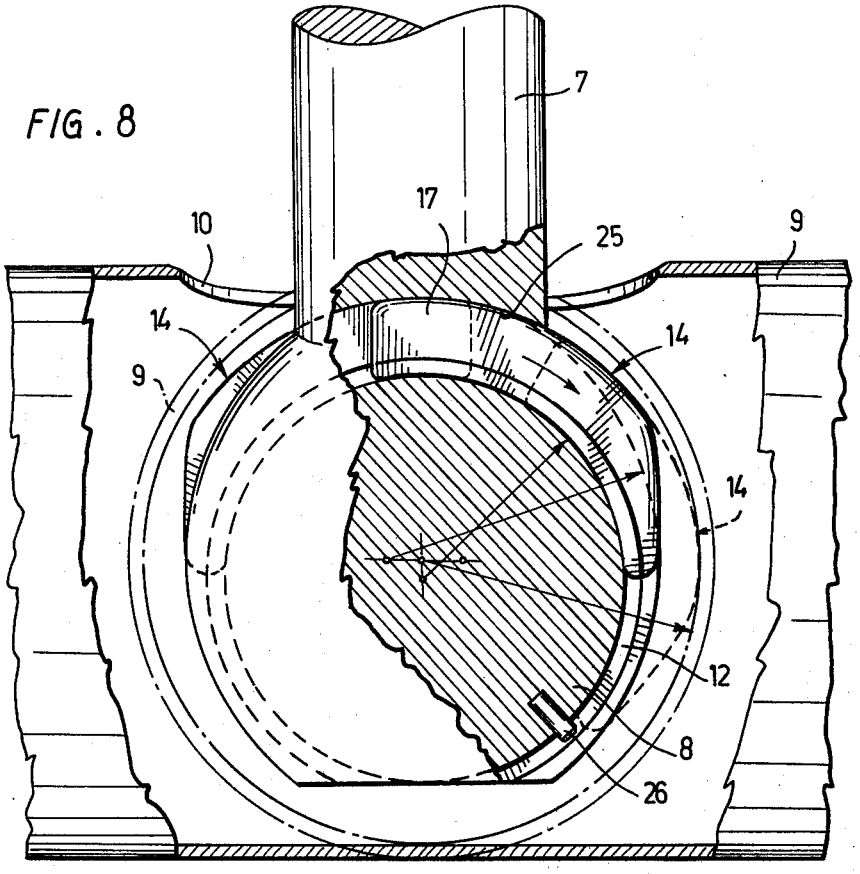
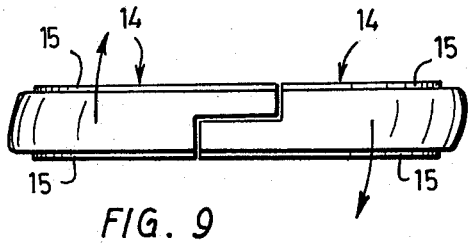
FIG. 9

DEVICE FOR FORMING A COLLAR AROUND A HOLE IN THE WALL OF A PIPE

This invention relates to a device for forming a collar around a hole in the wall of a pipe, comprising a rotary shaft, a body secured to one end of said shaft, collaring means supported on the body and rotating therewith around the rotary axis, and a driving means for moving the collaring means such that their action radius will increase as they are moved from an inserting position to a collaring position.

Such a device is known, for example, from German Patent Specification No. 1,931,897 in which the collaring means comprising two balls fit into spaces formed in the body so that they do not extend outside the body as the device is passed through an elliptical hole preformed in the wall of a pipe. When the body is located within the pipe, the balls can be moved some distance away from the centre axis of the device by inserting a cone-headed pin between the balls. Now the balls project laterally from the body, and as the body is pulled out through the hole in the pipe, the projecting part of the balls will form a collar around the hole.

From German Patent Specification No. 1,752,749 is known a device in which pin-like collaring means pass through a drill steel and with their rear end press against the control device of the collaring means. Thus, the collaring means abut on the drill steel, which is weakened due to holes bored for the collaring means and which cannot be given a very large diameter.

These and other devices based on the same principle operate satisfactorily on pipes having a small wall thickness or made of relatively soft material. As the wall thicknesses and material hardnesses increase, the fairly poor support of the collaring means will be of more and more disadvantage so that these devices no longer can be used on pipes of a very large diameter.

It is the object of the present invention to provide a stabler but still rapid device for forming a collar which is applicable under any conditions but whose advantages are particularly apparent when working on thick-walled pipes made of a hard metal, such as stainless steel. According to the invention, this object is achieved such that the body is in a plane including the rotary axis provided with outwardly curved support surfaces extending to the collar forming point, the radial distance of said surfaces from the rotary axis being biggest in the area between the end parts of the support surface, and the collaring means, which are elongated in the direction of curvature, being arranged for movement along said surfaces in the plane of the rotary axis such that during the collaring operation the reaction force component acting in the plane of the rotary axis without the friction force component between the collaring means and the support surface is directed approximately perpendicularly to the support surface. Thus, the action radius of the collaring means can be varied by moving them along the curved support surface. Because the collaring means are supported directly on the body, which is massive and remains unchanged during the different steps of the collaring operation, the device can be made very stable is of advantage when forming collars in thick-walled pipes. Because of the curvature of the support surface, the reaction forces acting during the collaring operation will be directed approximately perpendicularly to the support surface which does not vary during the collaring operation but is part of the surface of the body located between the collaring means. The collaring means are preferably arranged to move in grooves in the body which gives the means a good lateral support.

Figure 2:
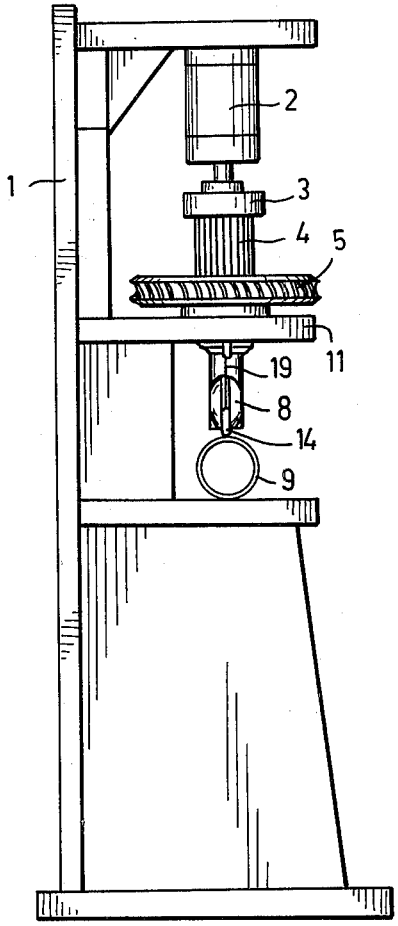
Figure 7:
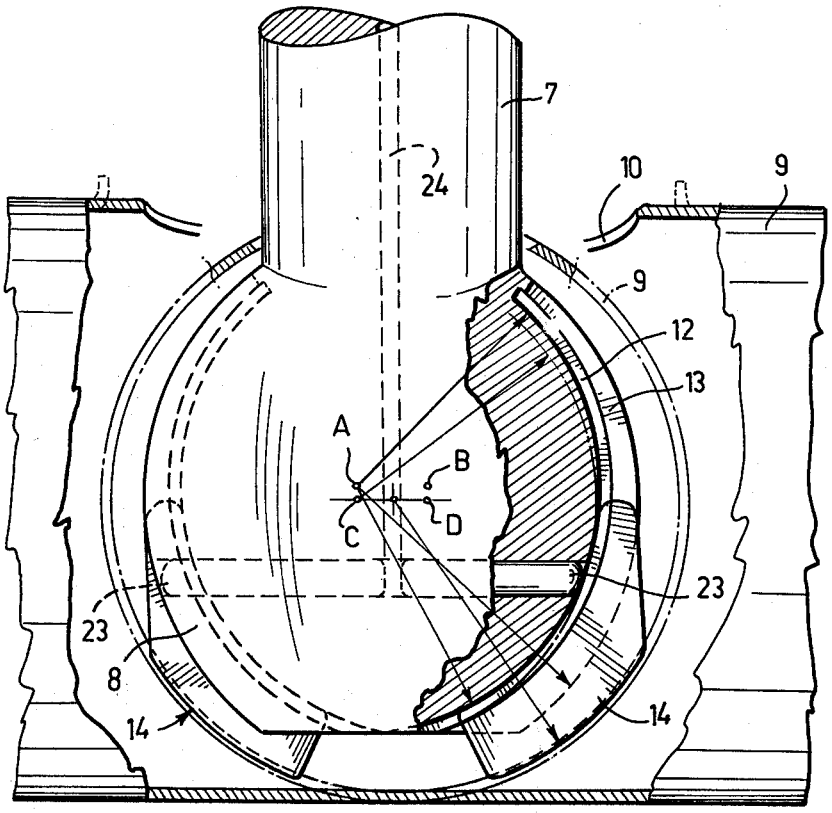

The invention will now be described in more detail with reference to the accompanying drawing wherein FIG. 1 is a front view of an aggregate in which the device according to the invention is included, FIG. 2 is a side view of the aggregate, FIG. 3 is a side view of the device according to the invention in the inserting position, FIG. 4 illustrates the device according to FIG. 3 in the collaring position, FIG. 5 is a section along the line V—V in FIG. 4, FIG. 6 is a section along the line VI—VI in FIG. 4, FIG. 7 is a side view of a second embodiment of the device according to the invention, FIG. 8 is a side view, partially in section, of a third embodiment of the device according to the invention, and FIG. 9 is a top view of the collaring means according to FIG. 8.

The aggregate according to FIGS. 1 and 2 has a frame 1 in the upper part whereof a hydraulic cylinder 2 is fastened whose piston rod is secured to a grooved shaft 4 by means of a bearing housing 3 containing both a roller and pressure bearing. The lower end of said shaft is encircled by a wheel 5 provided with circumferential helical teeth and driven by a screw shaft 6. The grooved shaft 4 is connected to a rotary shaft 7 of the device according to the invention, the latter shaft being an extension of the former one. A body 8, preferably integral, is provided at the free or lower end of the rotary shaft.

By means of the cylinder 2 the body 8 can be moved vertically from an upper position shown in FIGS. 1 and 2, in which it is located above a pipe 6 secured to a support, to a lower position, in which it is positioned within the pipe. The wall of the pipe is provided with a preformed elliptical hole 10 around which the collar is to be made. The screw shaft 6 again by means of the helical wheel 5 sets the body 8 in rotation around the rotary shaft 7. Interlocking grooves and ridges on the inner periphery of the wheel and in the grooved shaft permit simultaneous rotation and vertical movement of the body 8. The wheel 5 is mounted on a frame part 11.

The device according to the invention shown in FIGS. 3 to 6 comprises the body 8 connected to the rotary shaft 7. As appears from FIGS. 3 and 4, said body is placed within the pipe before forming the collar. From FIG. 6 it is seen that the body is elliptical in a plane perpendicular to the rotary shaft. Also in a plane parallel to the rotary shaft the body is somewhat elliptical, see FIG. 3, wherein the centres C and D of the outer peripheries of the body have been marked out. The cross-sectional area of the body shown in FIG. 6 is nearly as large as the hole 10 formed in the wall of the pipe. For the sake of clarity, in FIGS. 3 and 4, also an end view of the pipe is drawn from which it is seen that the diameter of the rotary shaft approximately corresponds to the smaller diameter of the elliptical hole 10.

At each end of the longest diameter of the elliptical body 8 there is provided a support surface 12 which is extending and curved in a plane including the rotary shaft and forms the bottom surface of a groove 13. In each groove there is an essentially wedge-shaped collaring fin 14 movable along the groove 13 and having a surface mating the support surface and of the same curvature as the support surface so that the collaring fin 14 in each of its positions rests on the support surface 12 of the body. Close to the bottom, the grooves are provided with longitudinal lateral recesses in which lateral lists 15 of the collaring fins 14 fit locking said fins into the grooves. From the free end of the body a segment shaped part is cut from which the collaring fins can be pushed into their grooves.

As appears from FIG. 3, the collaring fins are shaped so that they in the inserting position will extend right up to the periphery of the body. This is achieved by providing the collaring fins with a thin part 16 that becomes thicker in a wedge-like fashion and adjoins a curved part 17 that is of a nearly uniform thickness.

FIGS. 4 and 5 illustrate one conceivable arrangement for moving the collaring fins and locking them in place. The thin part 16 of the collaring means is provided with a hole 18 in which a wire 19 is fastened (see FIGS. 1 and 2) one end whereof is secured to an ear 20 in the bottom surface of the wheel 5. Preferably, the wire runs in a groove 21 formed in the surface of the rotary shaft 7. The wire is of such a length that it will lift the collaring fins to the upper or collaring position as the body moves into the pipe. To lock the collaring fins in this position, the body is provided with a through-bore 22 which is perpendicular to the rotary shaft and in which two locking pins 23 are positioned, one for each collaring fin 14. These locking pins can be made to project from the body under the lower end of the collaring fins, for example, by means of pressure air that can be fed to the centre of the bore 22 through a bore extending along the centre line of the rotary shaft from a pressure air source not shown.

The embodiment according to FIG. 7 very closely resembles the embodiment illustrated in FIGS. 3 to 6. The only difference is that the centres of the support surfaces are not located in the points C and D but in points A and B located at some distance above the centres A and B of the body periphery. Because of this arrangement, the depth of the grooves increases toward the free end of the body. By locking the collaring fin in different location in the groove, the action radius of said fins can be varied which is of advantage when the wall thickness varies in pipes of the same size.

The embodiments of the device according the FIGS. 3 to 7 function in the following manner.

When the pipe 9 to be provided with a collar has been fixed in place and the collaring fins are in the lower position according to FIG. 3 in which they will not extend outside the longest periphery of the body 8 in a plane perpendicular to the rotary shaft, the body 8 is by means of the cylinder 2 lowered into the pipe, see FIG. 3. As the body approaches the bottom of the pipe, the wire will be tightened and will pull the collaring fins 14 to the upper position according to FIG. 4 in which their thick part 17 will extend outside said periphery of the body. The locking pins 23 are then forced to project under the lower ends of the collaring fins by means of pressure air whereby they will lock the collaring fins in the upper position.

To form a collar around the hole 10, the screw shaft 6 and the cylinder 2 are started whereby the body starts to rotate around the rotary shaft 7 while at the same time moving up through the hole. The collaring fins accompanying the body will now shape the edges of the hole so as to form a collar around said hole whose edge, due to the elliptical initial hole, will be located in a plane perpendicular to the rotary shaft. When the collar has been formed, the locking pins 23 will be inserted in the body, and now the collaring fins can again drop to their lower position for the next collaring operation.

The embodiment according to FIGS. 8 and 9 differs from the previous ones only in that the junction between the body and the rotary shaft is provided with a through-bore 25 through which the support surface of the body extends without any discontinuity. The bore is dimensioned so as to receive the thick part 17 of the collaring fins 14 when the device is in its inserting position. At their thick end, the collaring fins are split so as to interlock in the bore 25 in the manner shown in FIG. 9. A stop pin 26 is provided in the lower part of the support surface.

When the body has been inserted in the pipe, the collaring fins 14 will drop in their grooves against the stop pin 26, as shown by the broken line in FIG. 8, and will now assume their collaring position. This embodiment has the advantage that no special drive means are required for the collaring fins. Because the bore 25 weakens the structure, at the sides of the rotary shaft in the direction of the shortest axis of the hole 10, material may be added even to such an extent that the diameter of the rotary in this direction will exceed the length of the smaller diameter of the hole 10. When inserting the body in the pipe, the corresponding edges of the hole will be to some extent bent outwardly which, however, will not cause any inconvenience.

Above, it has been stated that the collaring fins will form a collar when moving upwardly in the direction of the rotary shaft and when rotating around this shaft. In connection with very thick-walled pipes this combined movement, if used alone, may damage the inner surface of the collar wherefore, in some cases, it may be advisable to interrupt this movement a few times and to replace it merely with a vertical reciprocating movement in which case any damages to the wall will be avoided.

The drawing and the related specification are only intended to illustrate the idea of the invention. In particular, it should be noted that, for moving the collaring fins, a variety of different means, for example, operable by magnet or pressure air can be employed. The locking pin arrangement according to FIG. 4 can also be implemented such that springs will continuously force the locking pins 23 into the body in which case the locking pins will be inserted after the flow of pressure air has ceased.

While the collaring fins are moving along the support surface it is sufficient for them to have one component of movement along a plane a parallel to the rotary shaft. Also, the support surfaces need not be located on the bottom of grooves, and the number and shape of the collaring fins may also differ from what is described above.

I claim:

1. A device for forming a collar around a hole in the wall of a pipe, comprising a rotary shaft, a body secured to one end thereof, said shaft having at the other end a free end, collaring means supported on the body and rotating therewith around a rotary axis, and a driving means for moving the collaring means in a motion having an action radius such that said action radius will increase as they are moved from an inserting position to a collaring position, the said body being in a plane including said rotary axis provided with outwardly curved support surfaces extending to a collar forming point, the radial distances of said support surfaces from the rotary axis being biggest in the area between the end parts of each said support surface, and said collaring means, which are elongated in a direction of curvature, being arranged for movement along said support surfaces in the plane of said rotary axis such that during the collaring operation a reaction force component acting in the plane of the rotary axis without a friction force component between said collaring means and said support surface is directed approximately perpendicularly to said support surface.

2. A device as claimed in claim 1, wherein the curvature of said support surfaces in the body corresponds to a part of the circumference of a circle.

3. A device as claimed in claim 1, wherein said support surfaces in the body comprise the bottom surface of grooves formed in said body.

4. A device as claimed in claim 3, wherein said grooves in the body are T-grooves.

5. A device as claimed in claim 3, wherein the depth of said grooves increases toward the free end of said body.

6. A device as claimed in claim 1, wherein said collaring means are approximately wedge-shaped having a thicker end at one end thereof, and have a sliding surface abutting said support surface in said body, said sliding surface having a curvature corresponding to that of the support surface.

7. A device as claimed in claim 6, wherein the thicker end of said collaring means is located toward the free end of said body.

8. A device as claimed in claim 6, wherein at said sliding surface, said collaring means having lateral lists, said lateral lists fitting into lateral recesses in said grooves for locking the collaring elements in said grooves.

9. A device as claimed in claim 3, wherein the body in the cross-sectional plane of said rotary axis is elliptical, said grooves in the body being located at the ends of the biggest diameter of the ellipse.

10. A device as claimed in claim 1, comprising means for locking said collaring means in a collaring position, said locking means comprising locking pins perpendicular to the rotary axis and movable in a bore in said body so that they in the locking position protrude from said support surfaces in the body and in a second extreme position are entirely located within said body.

11. A device according to claim 1, wherein said collaring means in the collaring position are located along a biggest diameter of said body as viewed in a cross-sectional plane perpendicular to the rotary axis.

12. A device as claimed in claim 11, wherein said collaring means in the inserting position are located at the free end of said body.

13. A device as claimed in claim 11, wherein said collaring means in the inserting position are located at the end of said body adjoining said rotary shaft, said support surface thereby extending without any discontinuity through a bore extending through said end of the body, said collaring means being partly located in said bore in the inserting position.

* * * * *